US005964626A

United States Patent [19]

Varney et al.

[11] Patent Number: 5,964,626

[45] Date of Patent: Oct. 12, 1999

[54] TRACTOR PUMP JET

[75] Inventors: A. Michael Varney, Stuart, Fla.; Kimball P. Hall, Wading River, N.Y.; John D. Martino, Longwood, Fla.

[73] Assignee: Outboard Marine Corporation, Waukegan, Ill.

[21] Appl. No.: 09/205,818

[22] Filed: Dec. 4, 1998

Related U.S. Application Data

[63] Continuation-in-part of application No. 08/728,120, Oct. 9, 1996, Pat. No. 5,846,103, which is a continuation-in-part of application No. 08/518,368, Aug. 23, 1995, abandoned.

[51] Int. Cl.[6] ..... B63H 11/00

[52] U.S. Cl. ..... 440/38; 440/47

[58] Field of Search ..... 440/38, 46, 47, 440/67, 900; 60/221

[56] References Cited

U.S. PATENT DOCUMENTS

| | | | |
|---|---|---|---|
| 2,473,603 | 6/1949 | Miller | 115/16 |
| 2,965,065 | 12/1960 | Tinker | 115/42 |
| 3,112,610 | 12/1963 | Jerger | 60/35.5 |
| 3,153,905 | 10/1964 | Campbell | 60/35.6 |
| 3,249,083 | 5/1966 | Irgens | 115/12 |
| 3,389,558 | 6/1968 | Hall | 60/221 |
| 3,530,673 | 9/1970 | Huber | 60/221 |
| 3,672,169 | 6/1972 | Ufer | 60/230 |
| 3,734,050 | 5/1973 | Kitai et al. | 115/35 |
| 3,849,982 | 11/1974 | Hall | 60/221 |
| 3,906,886 | 9/1975 | Elger | 115/16 |
| 3,939,794 | 2/1976 | Hull | 115/16 |
| 4,023,353 | 5/1977 | Hall | 60/221 |
| 4,281,996 | 8/1981 | Mouraret | 440/89 |
| 4,459,117 | 7/1984 | Jordan | 440/38 |
| 5,273,467 | 12/1993 | Hall | 440/89 |
| 5,325,662 | 7/1994 | Varney et al. | 60/221 |
| 5,846,103 | 12/1998 | Varney et al. | 440/38 |

FOREIGN PATENT DOCUMENTS

| | | |
|---|---|---|
| 29041/67 | 10/1967 | Australia . |
| 2416162 | 8/1979 | France . |

*Primary Examiner*—Stephen Avila
*Attorney, Agent, or Firm*—John H. Pilarski

[57] ABSTRACT

A marine pump jet includes a rotor located upstream and in front of the rotor drive mechanism. The lower unit of the tractor pump jet has a rotor housing which substantially surrounds the rotor and a stator housing located downstream of the rotor and rotor housing. A drive shaft extending from an upper gear case enters the stator hub where a pinion gear engages a crown gear attached to the rotor shaft. This places the rotor drive mechanism downstream of the rotor so that the rotor is substantially the first mechanical element that water initially comes into contact with. The inlet opening of the pump jet is larger than the outlet opening at the outlet of the stator housing. Because the rotor operates on essentially undisturbed, non-turbulent water, it is more efficient than traditional pump jets where the rotor is located aft of the drive mechanism. The upper gear case includes a reverse shifting mechanism that permits the tractor pump jet to operate in either the forward or reverse direction.

36 Claims, 13 Drawing Sheets

168
214
34
116
200
128
168
126
7B
230
146
134
146
208
136
216
214
148
206
204
154
34
202
152
7B
104
145
143
212
144
164
160
132
158
162
156
124
112
114
106
108
110

TRACTOR PUMP JET

RELATED APPLICATIONS

This is a continuation-in-part of application Ser. No. 08/728,120 filed Oct. 9, 1996 now U.S. Pat. No. 5,846,103 and titled "Tractor Pump Jet" which is a continuation-in-part of application Ser. No. 08/518,368, filed Aug. 23, 1995 and titled "Tractor Pump Jet", now abandoned.

BACKGROUND OF THE INVENTION

1. Field of the Invention

The invention relates to marine pump jet apparatus.

2. Description of Related Art

Pump jets have been around for a number of years, but have not been widely used. They are generally characterized by a structure which includes a rotor and a stator section all surrounded by a housing. The upstream inlet of the housing is typically larger than the downstream outlet.

Pump jets, in general, have several advantages over traditional exposed propellers. First, because the rotor mechanism is shielded by the housing, it prevents swimmers, water skiers, skin divers, and the like, from being hit and injured by the rotating blades. This can be also important in areas where endangered wildlife, such as manatees, are located. Second, because the rotor is covered, it tends to be less likely to get caught in tow ropes, kelp, seaweed, etc. Third, under certain circumstances, the pump jet is more efficient than traditional exposed propellers. This makes the pump jet especially suitable for sports and military applications. Conventional pump jets are normally mounted as a retro-fit item onto the lower unit of a conventional outboard. This is a relatively simple and straight forward approach because it requires the minimal amount of modification of the outboard marine engine.

A conventional prior art outboard is illustrated in FIG. 1. An antiventilation plate (sometimes referred to as an "anti-cavitation" plate) is located between the mid-section of the outboard motor and the lower unit. The antiventilation plate prevents the naked rotating propeller from sucking air down from the surface, i.e., aspirating, thereby decreasing the thrust of the propeller. It would be very difficult to place a traditional naked propeller up front of the drive unit because the antiventilation plate would be much less effective in such an arrangement. Therefore, outboard propellers are generally located downstream of the drive unit under the protection of the antiventilation plate. One advantage of pump jets, however, is that they do not need antiventilation plates in view of the fact that the rotor and stator mechanisms are completely covered and protected by a housing.

There has been a moderate amount of effort to develop marine pump jets, even though they have not been widely accepted. Perhaps the best known of the inventors in this area is Dr. Kimball P. Hall whose name appears as inventor or co-inventor on the following U.S. patent which are representative of the state of the art: U.S. Pat. Nos. 3,389,558; 3,849,982; 4,023,353; 5,273,467; and, 5,325,662. All of the foregoing patents describe marine pump jets which are retrofitted onto the lower drive unit of an outboard motor and, therefore, are located downstream of the rotor drive mechanism.

It should be understood that a pump jet is not the same thing as a shrouded propeller. A typical example of a shrouded propeller is disclosed in U.S. Pat. No. 2,473,603. A shrouded propeller is simply a conventional outboard motor propeller surrounded by some form of shroud. A pump jet, on the other hand, has an axial flow pump impeller or rotor, rather than a propeller, because the pump jet is concerned with creating an increase in pressure or head instead of creating thrust. The blades of an axial flow pump rotor are not the same as propeller blades. To maximize the increase in pressure, it is desirable to minimize turbulence. To this end, a pump jet usually has inlet struts and stator vanes to straighten water flow through the pump jet, and the inlet is larger than the outlet.

While tractor pump jets have been employed successfully on outboard marine engines, it would be desirable to provide an arrangement wherein a pump jet can also be conveniently installed on an inboard/outboard or stern drive unit to replace the conventional propeller arrangement as now used.

SUMMARY OF THE INVENTION

A price is paid for mounting the pump jet downstream of the lower unit of the outboard. Specifically, the rotor operates on water that has been significantly disturbed by the "bullet" portion of the lower unit of the outboard. This reduces the efficiency of the pump jet. There is a need for a marine pump jet which can take in undisturbed water at the inlet in order to improve efficiency.

Briefly described, the invention comprises a "tractor" marine pump jet in which the rotor is located upstream of the rotor drive mechanism. In this manner, the rotor operates on water that is relatively undisturbed. According to a preferred embodiment, the lower drive unit of the tractor pump jet apparatus is attached to the upper gear case of a conventional inboard/outboard motor. A drive shaft from the power head of the inboard motor extends to the upper gear case and down into a stationary stator housing. A pinion gear attached to the drive shaft engages a crown gear attached to the rotor. The rotor is located upstream of the rotor drive mechanism. A circular housing completely surrounds the rotor. A rotor housing is attached to the stationary stator housing and located upstream thereof. A plurality of stator vanes structurally connect the stator hub to the inside of the stator housing. The rotor housing includes a circular inlet opening which is larger than the outlet opening at the end of the stator housing. A nose assembly protects the nut and cotter pin that attach the rotor to the rotor drive shaft. The nose assembly also extends slightly beyond and ahead of the inlet opening. Because the drive mechanism is located downstream of the rotor, the rotor acts upon inlet water that is relatively non-turbulent. This improves the efficiency of the overall mechanism.

These, and other features of the invention, will be more fully understood by reference to the following drawings.

DETAILED DESCRIPTION OF THE PREFERRED EMBODIMENTS

During the course of this description, like numbers will be used to identify like elements according to the different figures which illustrate the invention.

Figure 1:
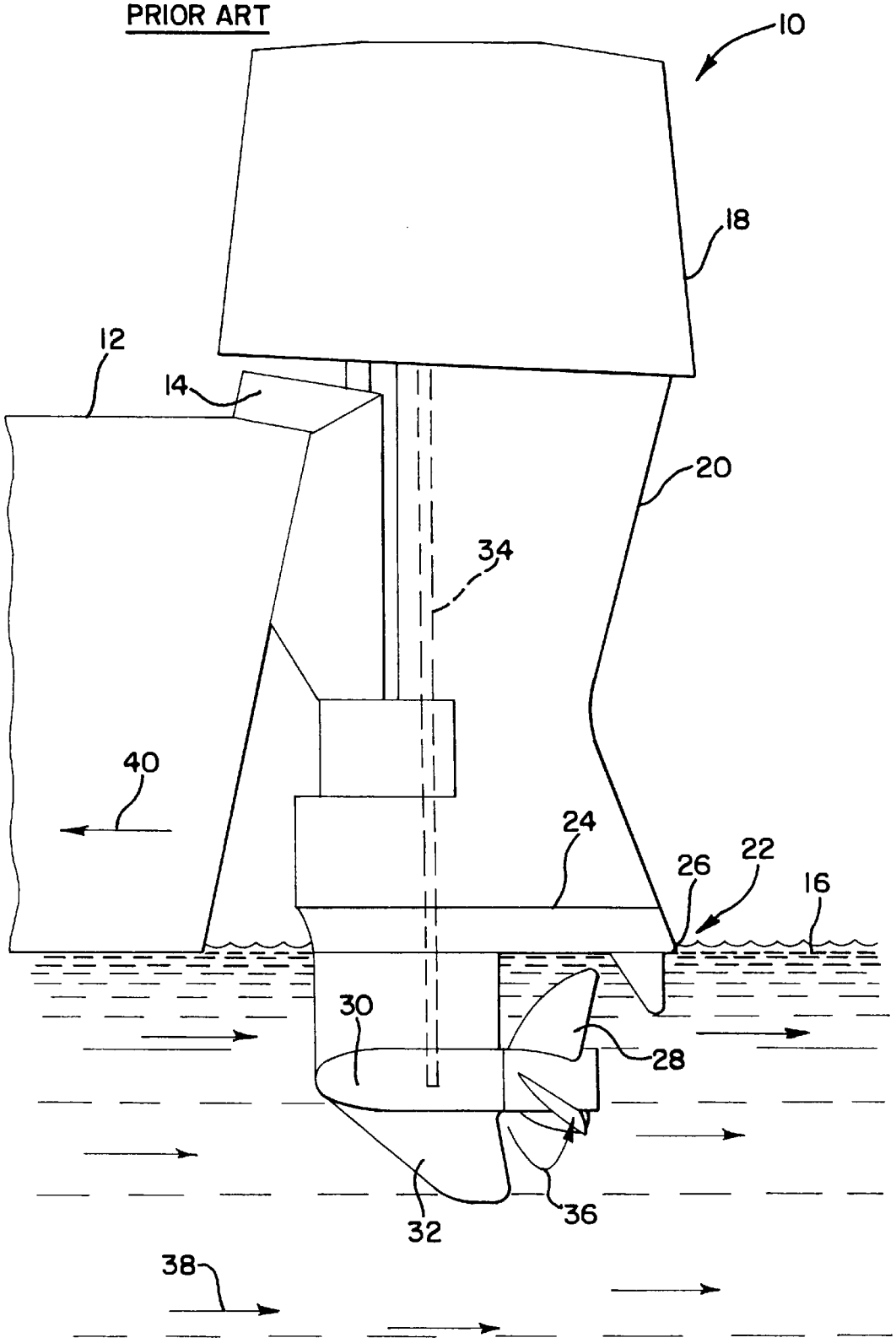
FIG. 1 PRIOR ART
FIG. 1 is an elevational, schematic view of a typical, prior art outboard motor equipped with a naked, rotating propeller.

A prior art outboard motor 10 is illustrated in FIG. 1 for reference. The prior art outboard motor 10 is connected to the stern or transom of a boat 12 by a conventional mounting bracket 14, so that the outboard motor is pivotal relative to the transom about a generally vertical steering axis and about a generally horizontal tilt axis. The boat 12 is typically employed in fresh or salt water 16. The powerhead 18 of the outboard motor 10 is structurally attached to a mid-section 20 which is, in turn, connected to a lower unit 22 through a bolt plate 24. An antiventilation plate 26 is located just below the water line and directly above the rotating propeller 28. Antiventilation plate 26 is necessary in all large size outboard motors in order to prevent the propeller 28 from sucking air from the surface of the water 16 into the water stream flowing through the propeller. Air ingested into the propeller 28 significantly decreases the efficiency and thrust of the prior art outboard motor 10. Therefore, antiventilation plates, such as illustrated by 26 in FIG. 1, are necessary when a naked propeller 28 is employed. They are generally not necessary, if a pump jet such as illustrated, for example, in FIGS. 2–7C, is employed. Lower unit 22 includes a "bullet" 30 which houses the propeller drive gear mechanism and a skeg 32 which provides the propeller 28 with some protection against being hit by submerged objects such as rocks, logs, etc. A drive shaft 34 connects the powerhead 18 to the propeller 28 through the gear mechanism in the bullet 30. This causes the propeller 28 to rotate in the direction of arrow 36 thereby propelling the boat 12 in a forward direction indicated by arrow 40 against the flow of water 16 indicated by arrow 38.

Prior art, naked propeller, outboard motors 10, such as illustrated in FIG. 1, have several shortcomings. First, and foremost, they are dangerous because the rotating propeller can hit swimmers, water skiers, seals, manatees, etc. Second, they require antiventilation plates, such as plate 26, in order to prevent the aspiration of air into the wash of propeller 28. If a propeller 28 is removed and retrofitted with a pump jet, such as described, for example, in the following previously cited prior art patents: U.S. Pat. Nos. 3,389,558; 3,849,982; 4,023,353; 5,273,467; and, 5,325,662, then some of the safety and efficiency problems have been addressed, but, because the retrofitted pump jets are located aft of the drive gear bullet, the water flowing into the pump is turbulent thereby decreasing the efficiency of the pump jet. In order to resolve this problem, a tractor pump jet was invented which permitted the rotor to be located upstream of its traditional place so that it can benefit from the intake of relatively undisturbed, nonturbulent flow.

Figure 2:
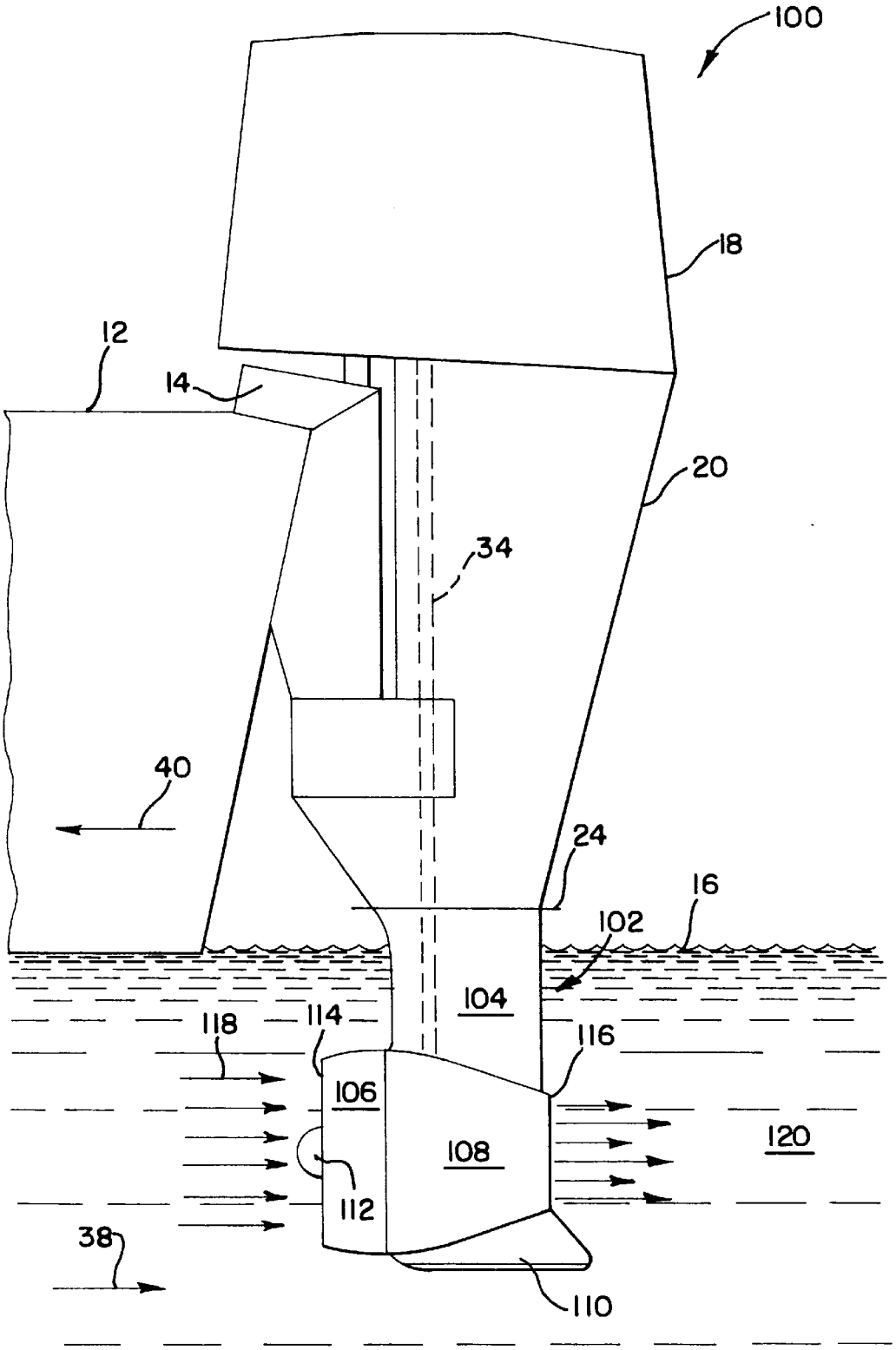
FIG. 2 is an elevational view of the marine tractor pump jet apparatus according to the preferred embodiment of the invention as attached to the powerhead and mid-section of a conventional outboard motor.

The preferred embodiment of the invention is illustrated in FIGS. 2–6. The preferred embodiment is referred to as a marine "tractor pump jet" because the rotor pulls the lower unit along rather than pushes it, as was the case with prior art propellers such as illustrated in FIG. 1. As shown in FIG. 2, the marine tractor pump jet lower unit 102 is attached to, and supported by, the mid-section 20 of the modified outboard motor 100. A bolt plate or plane 24 physically connects the mid-section 20 to the lower unit 102. A support strut 104 extends from the bolt plate 24 and attaches to the exterior of the pump jet housing which includes a rotor housing 106 and a stator housing 108. The pump jet housing is adapted to be submerged in open water and is externally streamlined for minimum drag losses in the water and maximum marine propulsion efficiency. In other words, for pump jets to operate efficiently, they must run submerged in open water. The rotor housing 106 has forward and rearward ends (left and right ends in FIG. 4) and a generally horizontal central axis. The forward end of the rotor housing 106 defines an inlet opening 114, such that there is no intake conduit upstream of the inlet opening 114 (to the left of the inlet opening in FIG. 4). The inlet opening 114 is circular, is centered on the central axis of the rotor housing 106, and is located in a generally vertical plane. The stator housing 108 has forward and rearward ends (left and right ends in FIG. 4) and a central axis coaxial with the central axis of the rotor housing 106. The forward end of the stator housing 108 is connected to the rearward end of the rotor housing 106 in a manner described below. The rearward end of the stator housing 108 defines an outlet opening 116 having a cross-sectional area substantially less than the area of the inlet opening. In the illustrated construction, the area of the inlet 114 is approximately 2.25 times the area of the outlet 116. In alternative embodiments, this ratio can be much less, and can approach one (the areas being equal), although the area of the inlet must always be greater than the area of the outlet. A skeg 110 is connected to the bottom side of the pump jet stator housing 108 and protects the lower unit 102 in the same manner that the prior art skeg 32 protects the prior art propeller 28 as illustrated in FIG. 1.

Figure 5C:
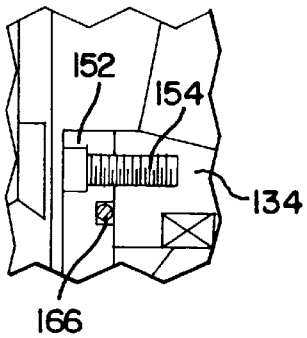
FIG. 5C is a detailed, cross-sectional view of the closure plate structure.
Figure 5A:
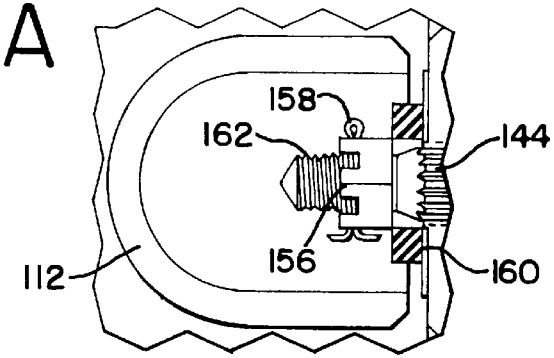
FIG. 5A is a detailed, cross-sectional view of the nose cover and rotor retaining nut assembly.

A nose cover assembly 112, illustrated in further detail in FIG. 5A, protects the rotor attachment nut 156 and extends upstream of the rotor inlet opening 114. Water 118, located directly ahead of the inlet 114 enters the housing 106, 108 and is expelled through the stator outlet opening 116 as a downstream jet 120. Inlet opening 114 is larger in cross-sectional area than outlet opening 116, thereby producing the jet effect.

Figure 3B:
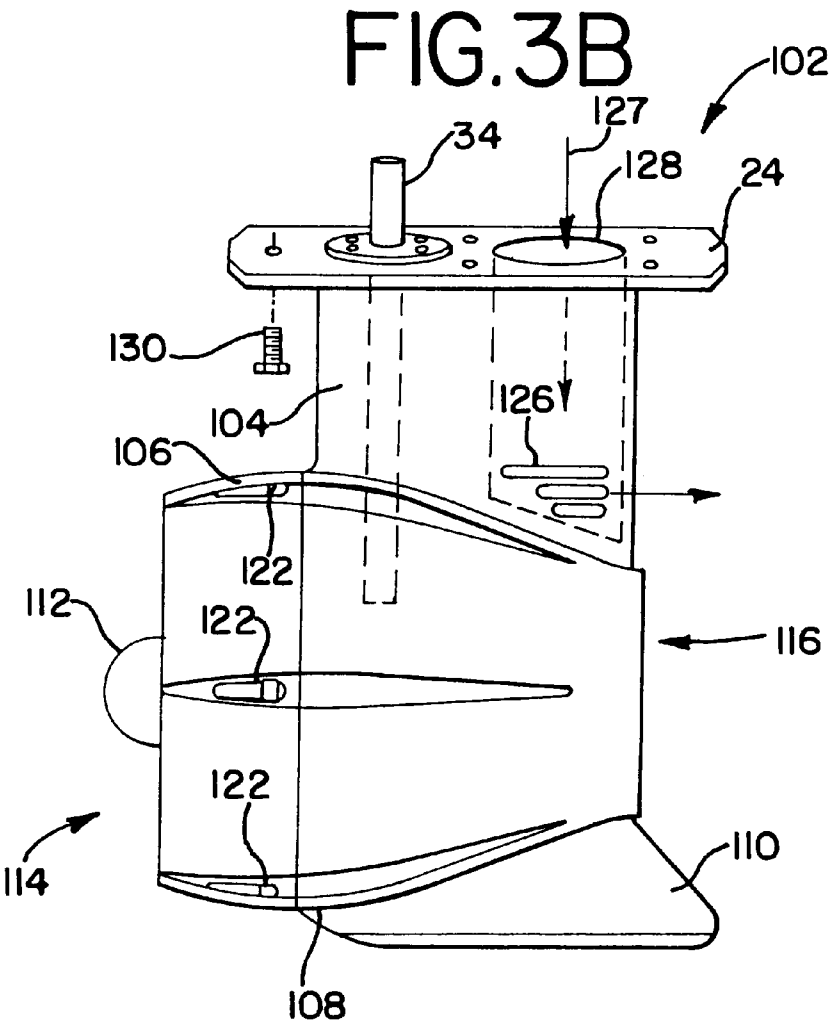
FIG. 3B is a side, elevational view of the tractor pump jet invention illustrated in FIG. 3A.
Figure 3A:
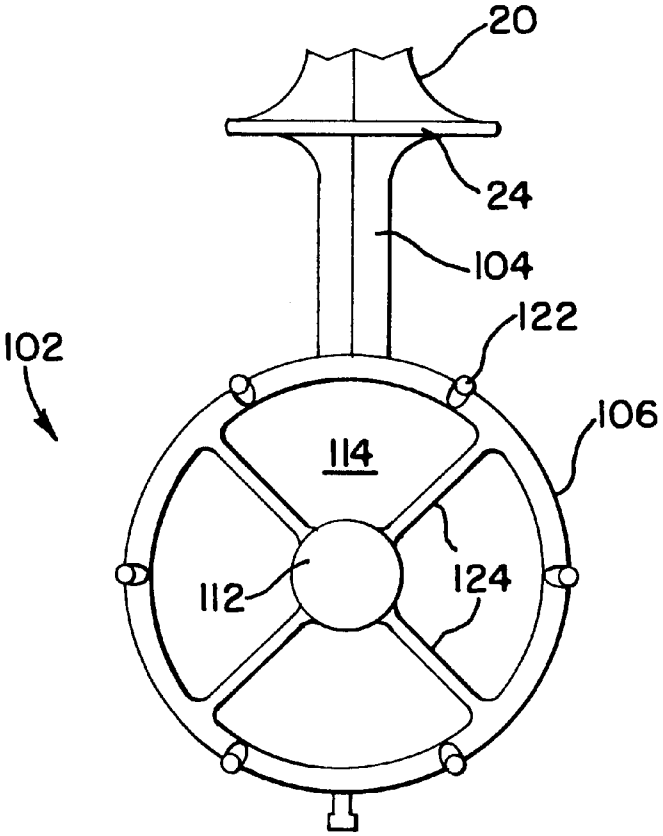
FIG. 3A is a front, elevational view of the preferred embodiment of the tractor pump jet invention.

FIG. 3A is a front, elevational view of the lower unit 102 illustrating the manner in which the easily removable rotor housing 106 is attached with bolts 122 to the stator housing 108. Four inlet struts 124 extend from the nose cover assembly 112 to the inside of the rotor housing 106. Struts 124 provide mechanical support to the nose cover 112 and also help to prevent debris and the like from entering into inlet opening 114.

FIG. 3B is a side, elevational view of the lower unit 102 of the tractor pump jet apparatus illustrated in FIG. 3A. Exhaust gases 127 from the powerhead 18 pass through chamber 128 and out of the exhaust gas exit slots 126, illustrated in further detail in FIG. 5D. The drive shaft 34 is shown passing through the lower bolt plate 24. The lower unit 102 is attached to the midsection 20 of the modified outboard 100 by five bolts 130 which pass through the lower bolt plate 24 and into an upper bolt plate, also 24, which is at the base of the mid-section 20.

Figure 4:
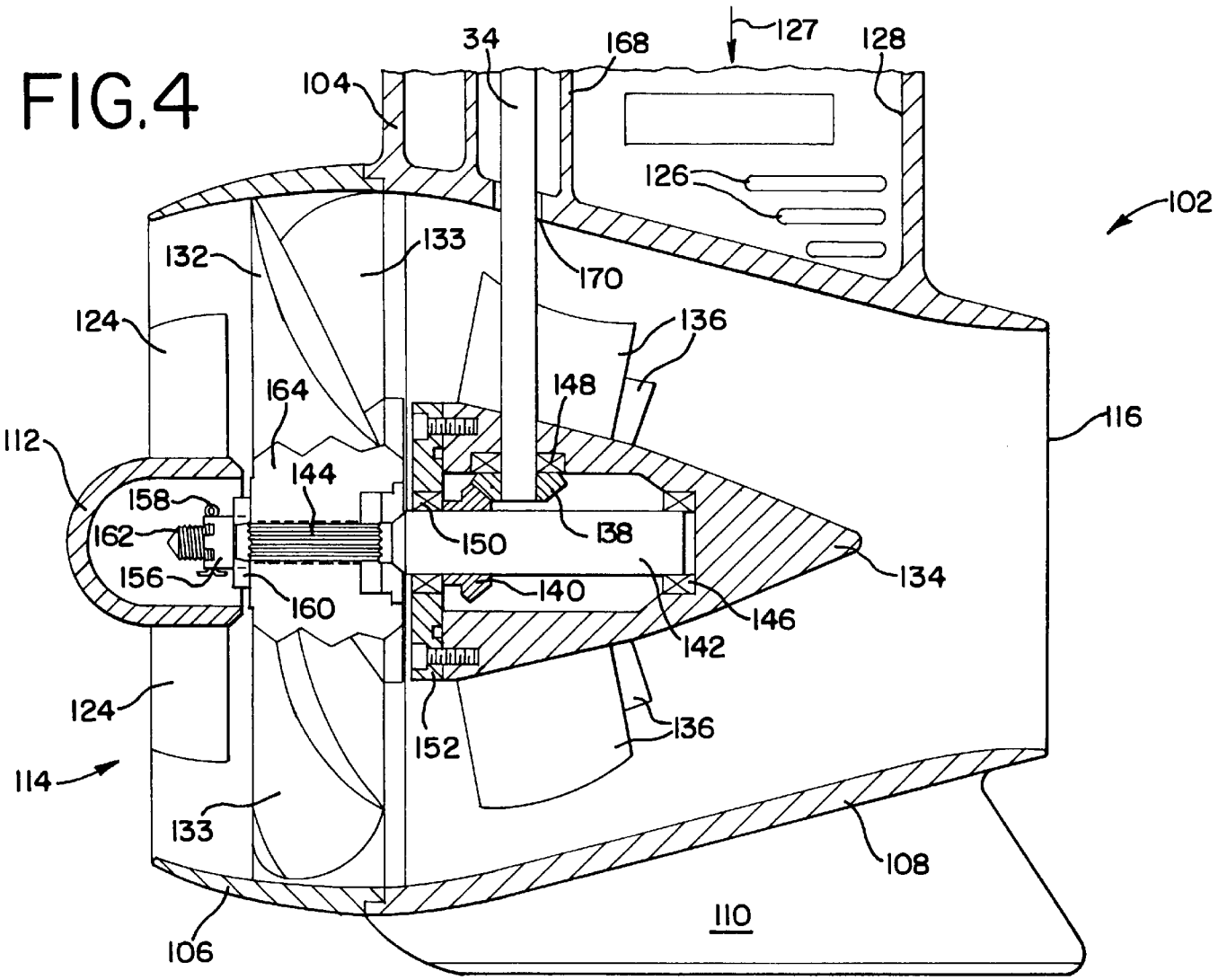
FIG. 4 is a side, elevational, cross-sectional view of the marine tractor pump jet apparatus according to the preferred embodiment of the invention and as illustrated in FIGS. 2, 3A and 3B.

FIG. 4 is a cross-sectional, elevational view of the lower unit 102 of the tractor pump jet. Axial flow pump rotor 132 is shown inside of rotor housing 106. Rotor 132 is located adjacent and immediately rearward of the inlet opening 114 so that it drinks in relatively undisturbed, non-turbulent flow, but is located upstream of or forward of the rotor drive mechanism which is housed within the stator hub 134 which includes the gear case. In the illustrated construction, the distance from the inlet opening 114 to the rotor 132 is less than one-half the diameter of the rotor 132. In alternative embodiments, this distance could be greater, but is preferably less than the diameter of the rotor. The tractor pump jet is single-stage in that it has only one rotor. The rotor includes a hub 164 and typically five vanes or blades 133. Each of the blades 133 has (see FIGS. 6A and 6D) an inner end connected to the rotor hub 164, an outer edge 133*a*, a leading edge 133*b* forming a sharp corner with the outer edge 133*a*, a trailing edge 133*c* forming a sharp corner with the outer edge 133*a*, and a width between the leading and trailing edges, the width changing from the inner end to the outer edge, such that the width is greatest at the outer edge 133*a*. In the illustrated construction, the width is least at the inner end and increases steadily to the outer edge. As shown in FIG. 6D, the outer edges 133*a* of the blades 133 define a cylinder centered on the rotor shaft 142. One of the rotor blades 133 is shown in crosssection, along a radial station, in FIG. 8. The rotor blades are designed in a manner known in the art of axial flow pumps and need not be described in greater detail.

Figure 8:
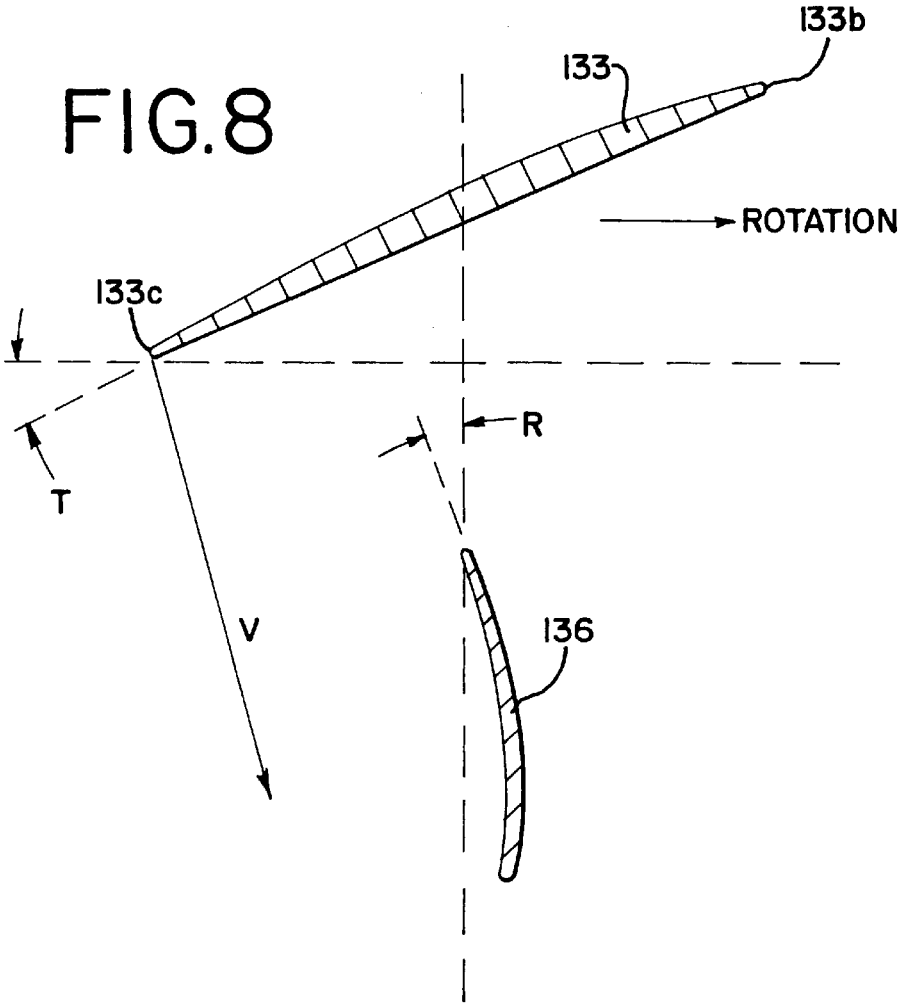
FIG. 8 is a cross-sectional view, along a radial station, of a rotor blade and a stator vane.
Figure 9:
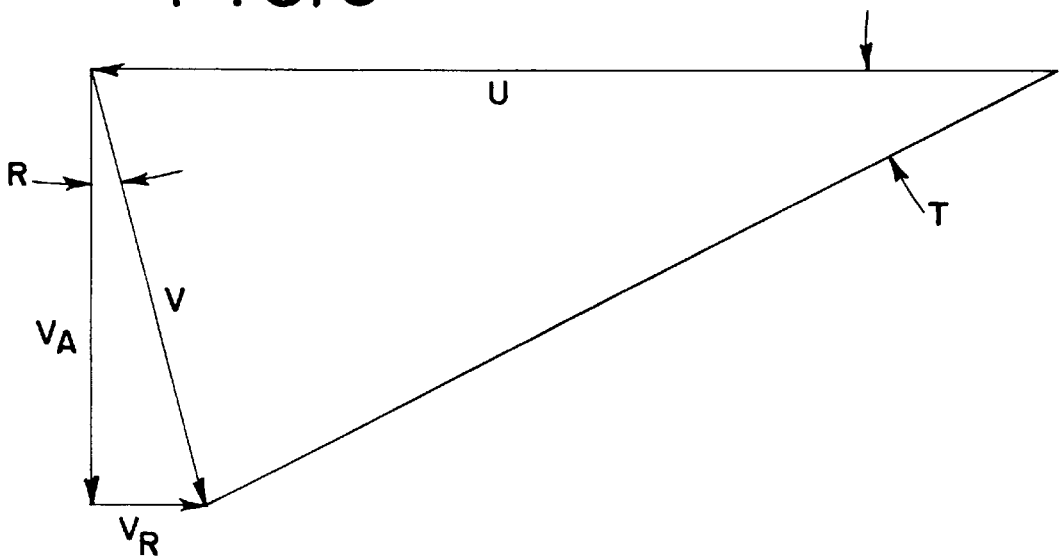
FIG. 9 is a vector diagram showing the resolution of vector V into its components.

Stator hub 134 is attached by typically eight stator vanes 136 to the inside of the stator housing 108. One of the stator vanes 136 is shown in cross-section, along a radial station, in FIG. 8. The stator vanes 136 are designed in a manner known in the art of axial flow pumps. Referring to FIG. 8, vector V represents the velocity of the water coming off the trailing edge of a rotor blade 133. Angle T is the angle of the trailing edge with respect to a plane perpendicular to the central axis of the pump jet housing. As is known in the art, this is also the desired relative angle of the leading edge of the stator vanes 136 with respect to the flow direction. Thus, the leading edge of each stator vane 136 is non-parallel to the central axis of the pump jet housing. FIG. 9 shows the vector V resolved into its components, $V_A$ (axial velocity) and $V_R$ (rotational velocity). Vector U represents the rotational velocity of the blade 133 at the particular radial station. The angle R between $V_A$ and $V_R$ is the desired angle of the leading edge of the stator vanes 136 with respect to the central axis of the pump jet housing. Thus, the leading edge of each stator vane 136 is non-parallel to the central axis of the pump jet housing. This construction of the rotor blades 133 and of the stator vanes 136 maximizes the ability of the stator vanes to neutralize the swirl component of the flow as it leaves the rotor, converting the swirl to axial flow.

Drive shaft 34 extends through the lower strut 104 and through the stator housing 108 into the interior of the stator hub 134. A pinion gear 138 is attached to the bottom of shaft 34 and engages a crown gear 140 attached to the rotor shaft 142. A set of splines 144 at the upstream end of rotor shaft 142 engage grooves 172, shown in FIGS. 6A–6D, of the rotor 132. A pair of bearings and seals 146 and 150 support rotor shaft 142. Another bearing/seal 148 locates and protects the shaft 34 at the point that it enters the stator hub 134. A closure plate 152 is attached by bolts 154 to the stator hub 134 as also illustrated in cross-sectional detail in FIG. 5C. A rotor retaining nut 156 is threadably received on the threads 162 at the furthest upstream end of the rotor shaft 142. A cotter pin 158 keeps the rotor retaining nut 156 from backing off of the rotor retaining washer 160 and the rotor shaft 142 as illustrated in FIG. 5A. The nose cover 112, which extends beyond the inlet opening 114, protects the rotor attachment elements 156, 158, 160 and 162.

Figure 5B:
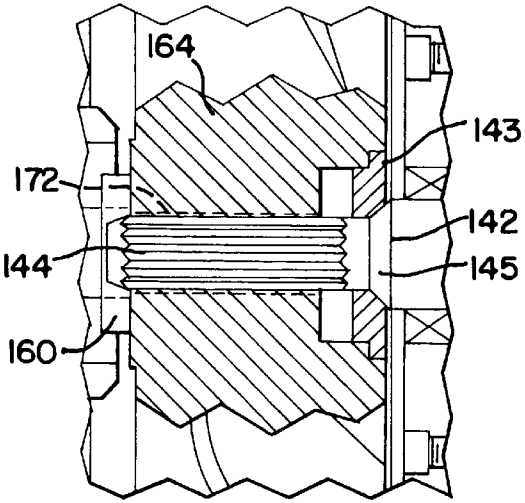
FIG. 5B is a detailed, cross-sectional view of the rotor spline and thrust washer assembly.

FIG. 5B is a cross-sectional detail of the rotor hub 164 illustrating how the splines 144 on the rotor shaft 142 engage with the grooves 172 in the rotor hub 164. A thrust washer 143 surrounds shaft 142 downstream of the rotor 132 and serves, during reverse operation, to transfer thrust forces from the rotor 132 to the rotor shaft 142 at the downstream conical step 145 in the rotor shaft and abuts closure plate 152. Also, as previously discussed, note the groove 172 elements in FIGS. 6A–6D.

The cross-sectional detail of FIG. 5C illustrates how O-ring 166 prevents leakage of water past the closure plate 152 into the stator hub 134.

Figure 5D:
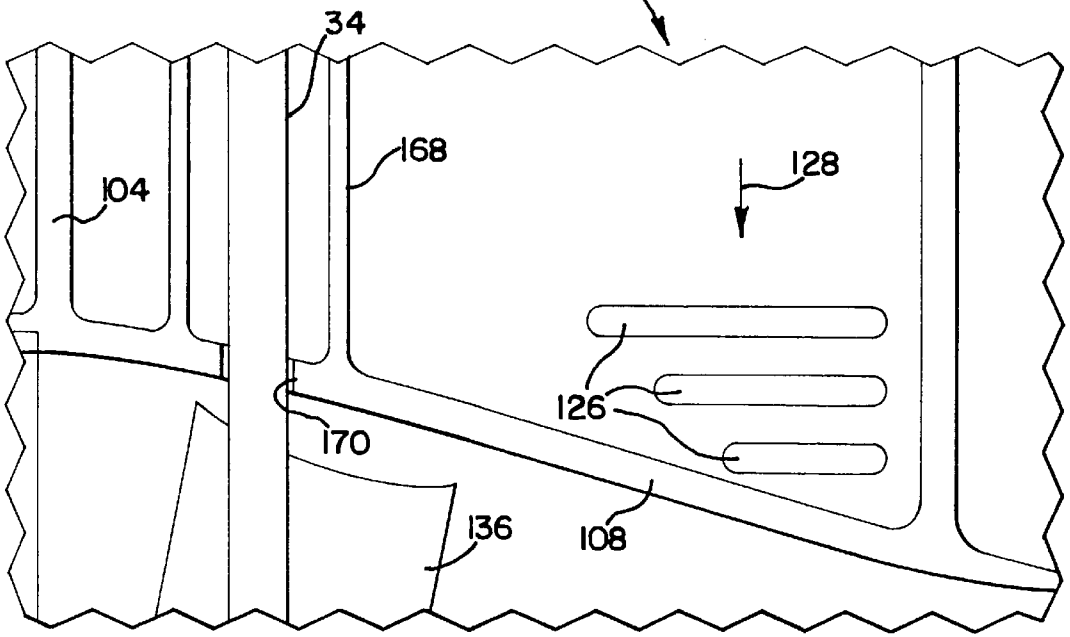
FIG. 5D is a detailed, cross-sectional view of the drive shaft and exhaust gas duct system.

FIG. 5D is a cross-sectional detail of the drive shaft and exhaust gas duct system. As previously described, exhaust gases 127 enter through chamber 128, as also seen in FIGS. 3B and 4, and are discharged through the exhaust exit slots 126. Drive shaft 34 passes through a teardrop-shaped sleeve 168 molded into the major lower strut structure 104. Sleeve 168 extends from the lower bolt plate 24 (at the top) to the upper surface of the stator housing 108 at the bottom. Shaft 34 finally passes through a circular annulus 170 into the interior of the stator housing 108 and terminating in the stator hub 134, as also seen in FIG. 4.

Figure 6B:
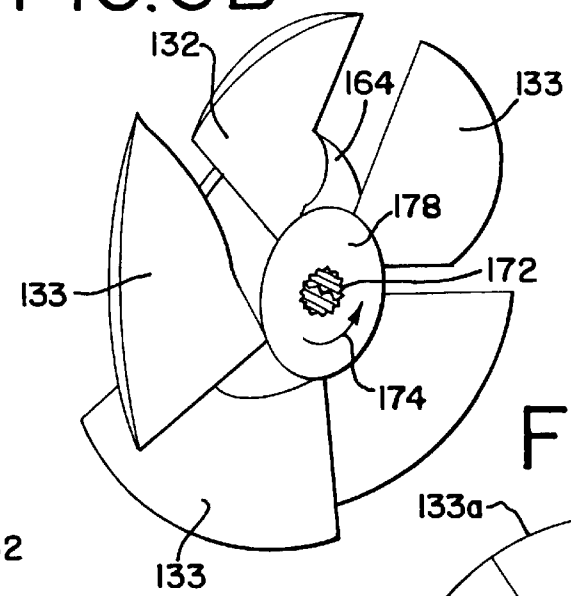
FIG. 6B is a perspective front view of the rotor.
Figure 6D:
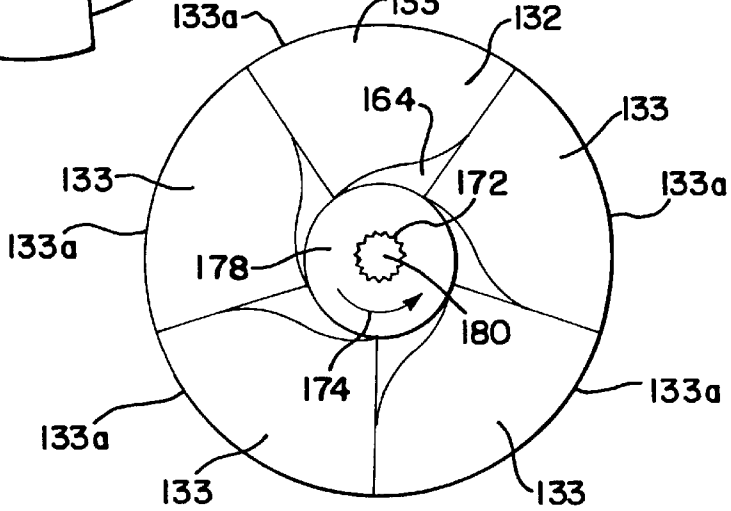
FIG. 6D is a front, elevational view of the rotor.
Figure 6C:
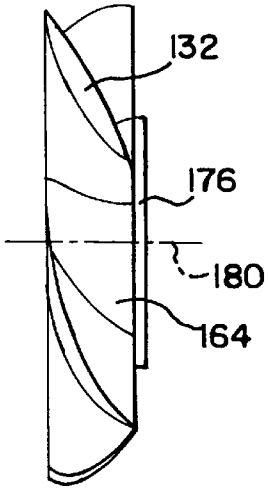
FIG. 6C is a side, elevational view of the rotor.
Figure 6A:
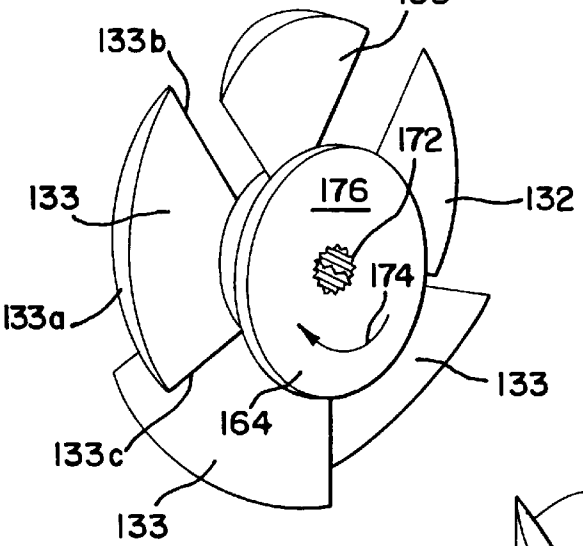
FIG. 6A is a perspective rear view of the rotor.

FIG. 6A is a rear, perspective view of the rotor 132 including its vanes or blades 133. The rear face 176 of the rotor hub 164 is visible. Grooves 172 engage with the spline 144 on the rotor shaft 142 as shown in FIGS. 4 and 5B. When the rotor 132 rotates, it travels in the direction of arrow 174.

FIG. 6B is a perspective front view of the rotor 132 and vanes showing the front face 178 of the rotor hub 164. When seen in this perspective, the rotor 132 travels in the direction of arrow 174.

FIG. 6C is a side, elevational view of the rotor 132 and vanes showing the relationship of the elements to the central axis 180.

FIG. 6D is a front, elevational view similar to that of FIG. 6B.

The stator housing 108, the rotor housing 106, the stator hub 134 and the rotor hub 164 define, inside the stator housing 108 and the rotor housing 106 and outside of the stator hub 134 and the rotor hub 164, a flow passage which extends between the inlet opening 114 and the outlet opening 116, which has a cross-sectional area along the length thereof, which contains the rotor 132, and through which captured inlet water flows. The cross-sectional area of the passage changes such that the cross-sectional area of the passage is smallest at the outlet opening 116. In the illustrated construction, the cross-sectional area of the passage increases rearwardly of the inlet opening 114 to a point adjacent the rotor 132, and then decreases rearwardly from adjacent the rotor 132 to the outlet opening 116. The interior of the stator housing 108 and the rotor housing 106 and the exterior of the stator hub 134 and the rotor hub 164 contact the captured inlet water and are streamlined for minimum turbulence, minimum flow separation and minimum hydrodynamic losses and for maximum marine propulsion efficiency. The inlet struts provide structural integrity and minimization of turbulence of captured inlet water.

Figures 7A, 7B:
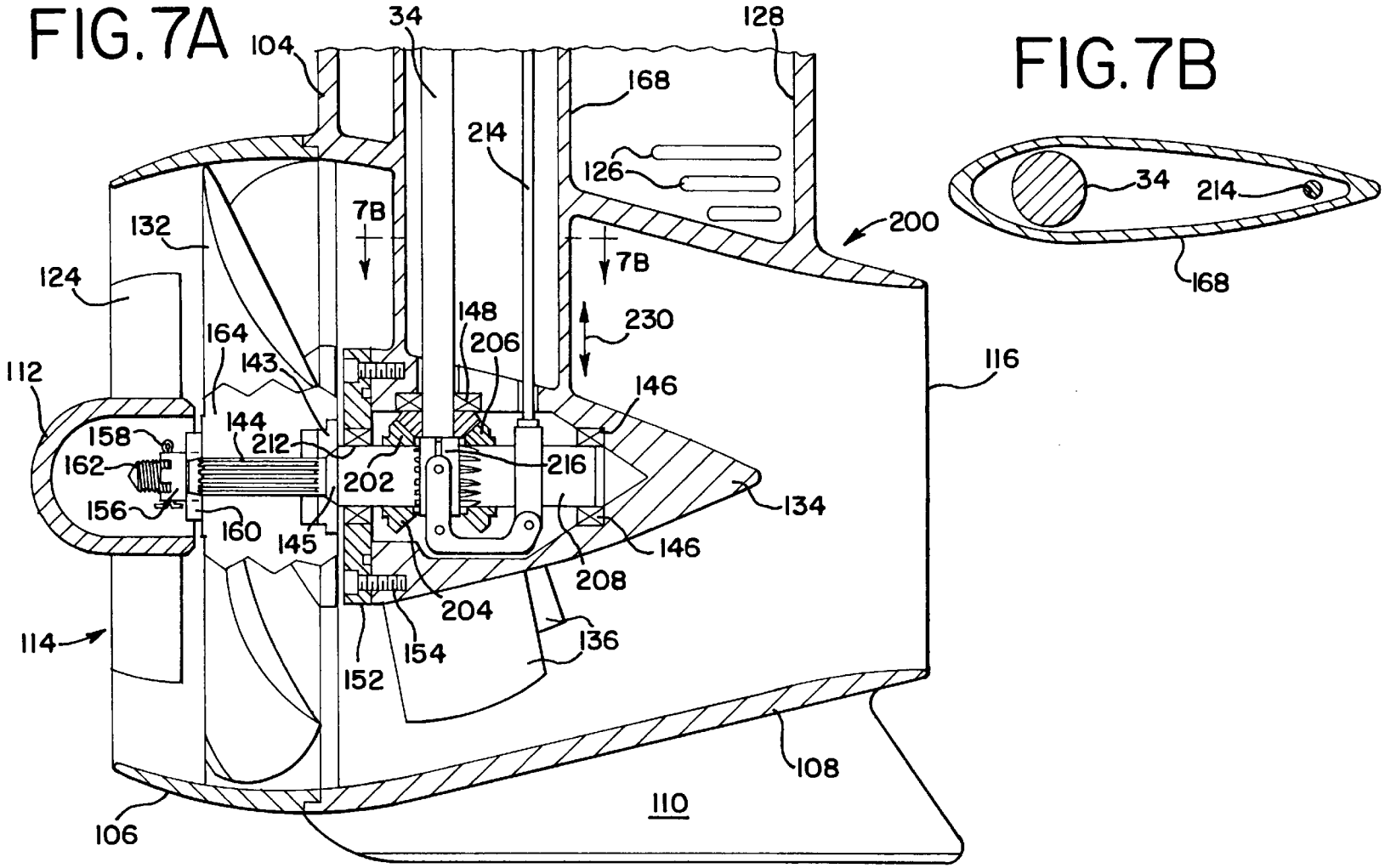
FIG. 7A is a cross-sectional view of an alternative embodiment of the invention which includes a reverse shifting mechanism.
FIG. 7B is a cross-sectional view of the drive shaft and shift rod shown in FIG. 7A taken from perspective 7B—7B.
Figure 7C:
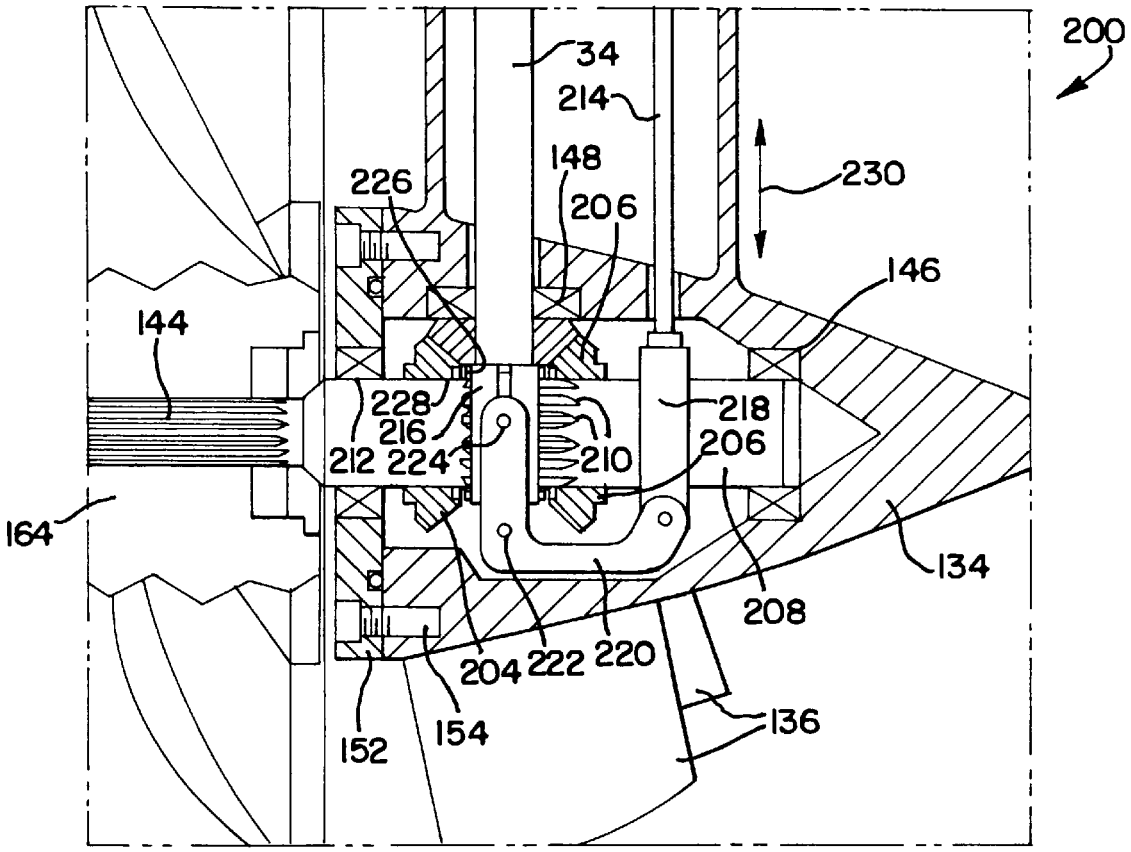
FIG. 7C is a detailed, cross-sectional view of the reverse shifting mechanism shown in FIG. 7A.

In FIGS. 7A–7C the stator hub 134 is shown containing gearing and shifting elements which enable this part to play the role for the tractor pump jet which is played by the bullet 30 for the outboard motor 10 in FIG. 1—to provide both forward and reverse thrust.

FIG. 7A is a cross-sectional, elevational view of the lower unit 102 of the tractor pump jet according to an alternative embodiment 200 of the invention which permits the tractor pump jet to operate in reverse as well as forward. The same element numbers are used to identify the same elements in the alternative embodiment 200 as are used to identify elements in the preferred embodiment 100.

As illustrated in FIG. 7A, rotor 132 is shown inside of rotor housing 106. Rotor 132 is located adjacent the inlet opening 114 so that it drinks in relatively undisturbed, nonturbulent flow, but is located upstream of the rotor drive mechanism which is housed within the stator hub 134 which includes the gear case. Stator hub 134 is attached by eight stator vanes 136 to the inside of the stator housing 108. Drive shaft 34 extends through the lower strut 104 and through the stator housing 108 into the interior of the stator hub 134. A pinion gear 202 attached to the bottom of shaft 34 engages two crown gears attached to the rotor shaft 208, specifically, a "forward" crown gear 204 and a "reverse" crown gear 206. A set of splines 144 at the upstream end of rotor shaft 208 engage grooves 172, shown in FIGS. 6A–6D, of the rotor 132. A combination bearing/seal 212 supports the rotor shaft 208 at its upstream end, and a simple bearing 146 supports the shaft at its downstream end. Another simple bearing 148 locates the drive shaft 34 as it enters the stator hub 134. A closure plate 152 is attached by bolts 154 to the stator hub 134. A rotor retaining nut 156 is threadably received on the threads 162 at the furthest upstream end of the rotor shaft 208. A cotter pin 158 keeps the rotor retaining nut 156 from backing off of the rotor retaining washer 160 and the rotor shaft 208. The nose or bullet cover 112, which extends beyond the inlet opening 114, protects the rotor attachment elements 156, 158, 160 and 162. A thrust washer 143 surrounds shaft 208 downstream of the rotor 132 and serves, during reverse operation, to transfer thrust forces from the rotor 132 to the rotor shaft 208 at the downstream conical step 145 in the rotor shaft and abuts closure plate 152.

FIG. 7B is a cross-sectional detail view taken from perspective 7B—7B in FIG. 7A showing sleeve 168, which has a teardrop-like shape, containing the drive shaft 34 and the shift rod 214.

The stator hub 134 is shown in further cross-sectional detail in FIG. 7C. A shifter dog 216 is located on a spline on the rotor shaft 208, with the two crown gears 204, 206 flanking it. The crown gears 204, 206, which are free to rotate independently on the rotor shaft 208, are driven by the pinion gear 202, and rotate continuously as long as motive power is supplied to the drive shaft 34.

In FIG. 7C as drawn, the shifter dog 216 is in NEUTRAL position, so that rotor shaft 208 remains stationary, even though drive shaft 34 is rotating. To move the boat 12 forward, the shift rod 214 is pulled upward, as suggested by arrows 230, by suitable linkages similar to those used on prior art outboard motor 10. This in turn lifts the shifter yoke 218, causing the shifting levers 220 (one on each side of the rotor shaft 208) to pivot around the pivot rod 222 (which is affixed to the walls of the stator hub 134 by a press fit or equivalent method). The dog shift pins 224 cause the shifter dog 216 to move to the left on its shifter spline 210. Engagement pins 226 are thereby pushed into engagement sockets 228 in the "forward" crown gear 204, and the rotor shaft 208 commences to rotate the rotor 132 in a direction suitable to cause rearward flow of water, and consequent development of forward thrust.

Similarly, a downward push on the shift rod 214, as also suggested by arrows 230, causes the shifter dog 216 to engage the "reverse" crown gear 206, rotating the rotor 132 in the opposite direction, thereby producing reverse thrust.

Figure 10:
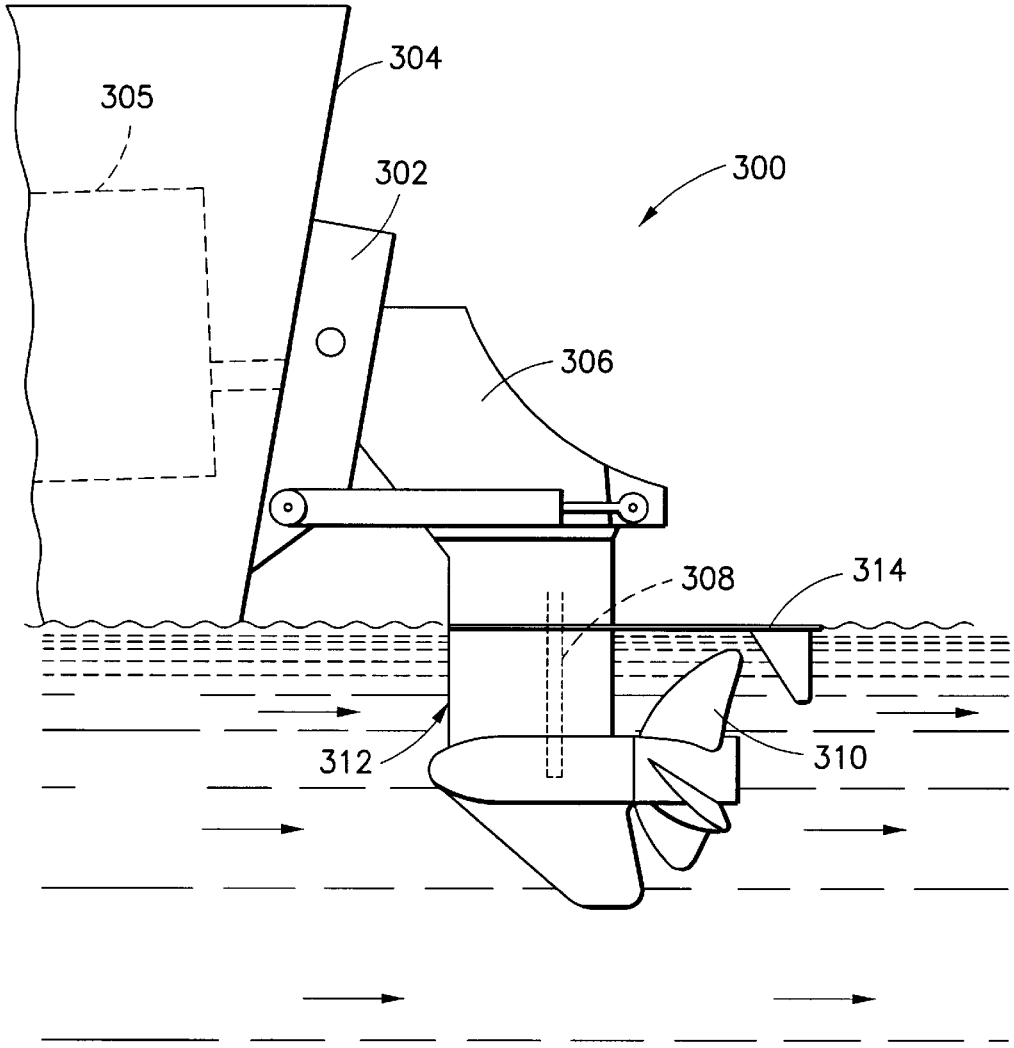
FIG. 10 PRIOR ART
FIG. 10 is an elevational, schematic view of a typical inboard/outboard drive assembly equipped with a naked, rotating propeller.

Turning now to FIG. 10, there is illustrated a prior art inboard/outboard, or stern drive, unit of conventional design, designated generally by the reference numeral 300. In a manner well known in the art, the unit 300 includes a transom mount assembly or bracket 302 secured to the stern or transom 304 of the boat hull and which serves to transmit power from an engine 305 mounted inside the boat, to an upper gear case assembly 306. The gear case assembly 306, in turn, transfers power through a drive shaft 308 to a propeller 310 through a suitable drive gear assembly (not shown) contained within a lower unit 312. The gear case assembly is mounted on the bracket 302 for pivotal movement about a generally horizontal tilt axis and about a generally vertical steering axis. As in typical outboard motor construction, an antiventilation plate 314 separates the lower unit 312 from the gear case assembly 306.

Figure 11:
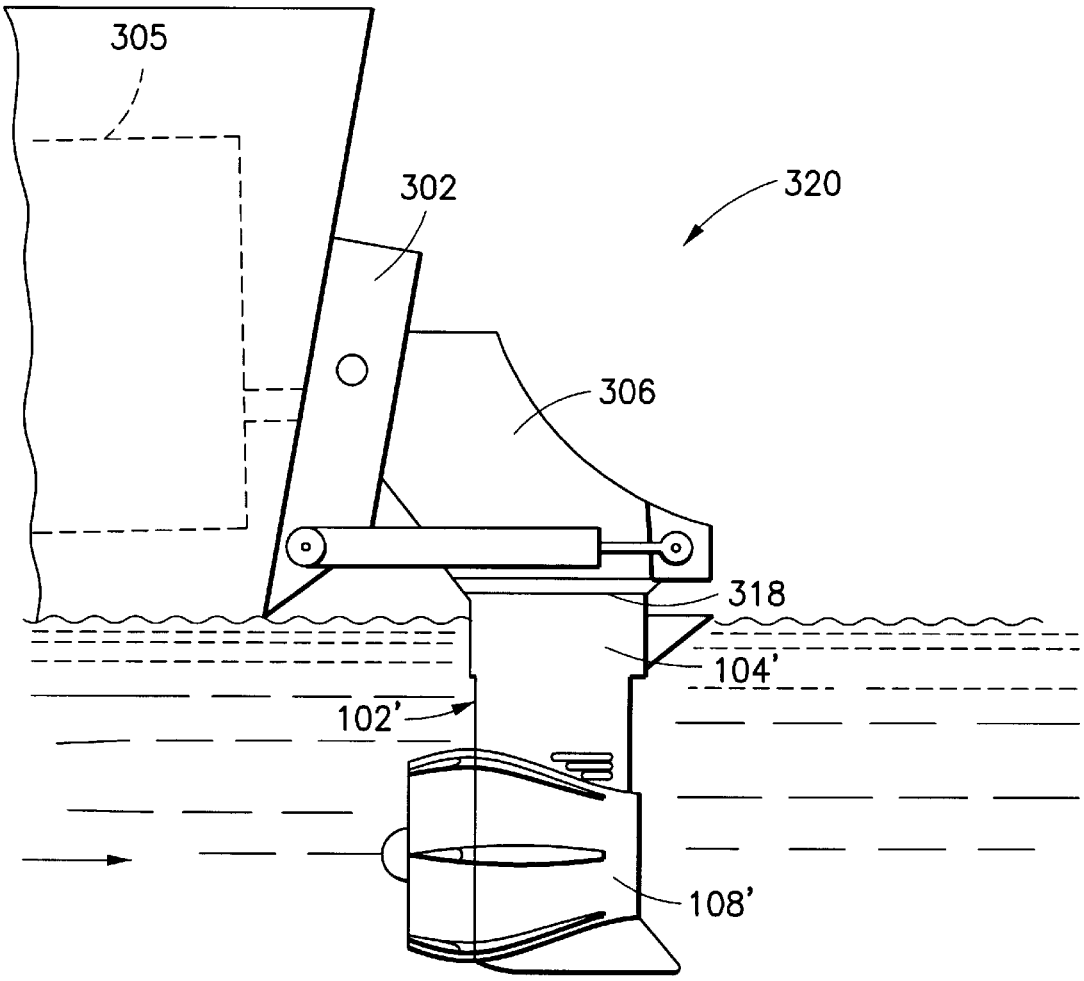
FIG. 11 is an elevational, schematic view of the marine tractor pump jet according to another embodiment of the invention as attached to the upper gear case of a conventional inboard/outboard drive unit.
Figure 12:
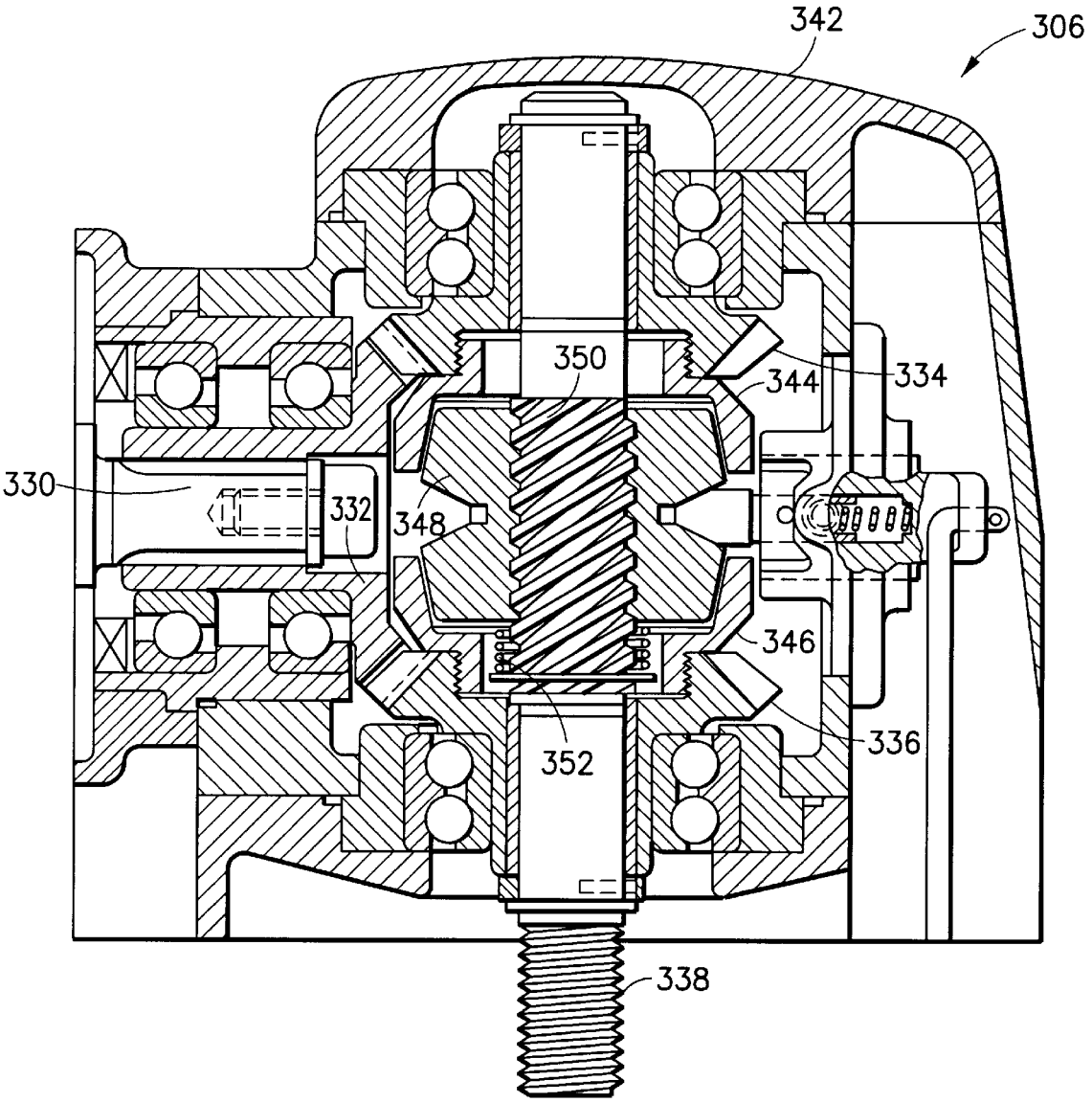
FIG. 12 PRIOR ART
FIG. 12 is a longitudinal sectional view of a prior art upper gear case assembly of a typical inboard/outboard drive unit.
Figure 13:
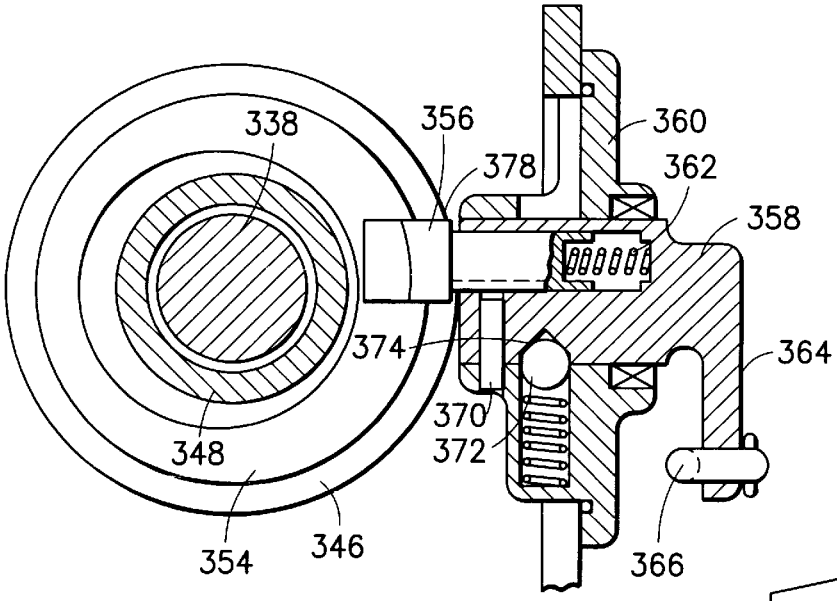
FIG. 13 is a cross-sectional view of the control members for assembly of FIG. 12.
Figure 15:
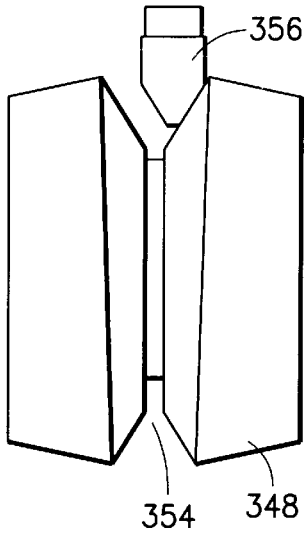
FIG. 15 is an elevation of a clutch element for the assembly of FIG. 12.
Figure 14:
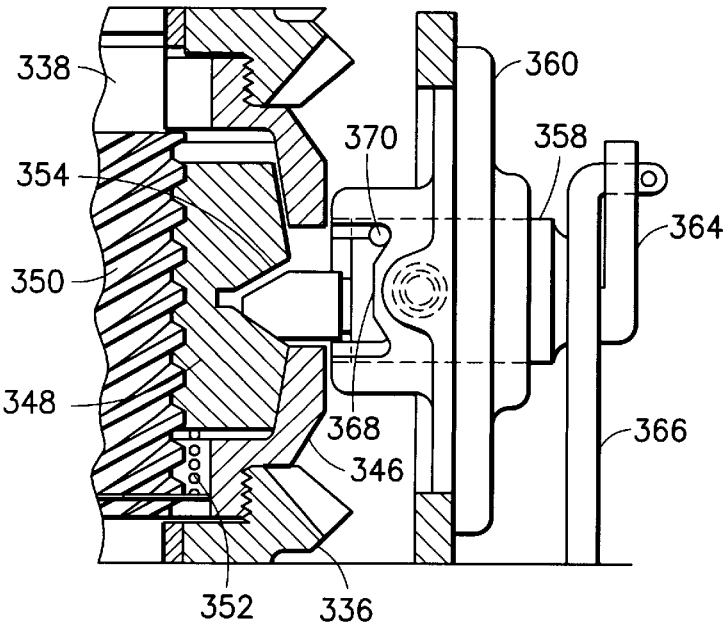
FIG. 14 is a longitudinal sectional view taken at right angles to FIG. 13.

FIG. 11 illustrates another preferred embodiment of the invention wherein a tractor pump jet lower unit 102' is fitted to the upper gear case assembly 306 as by bolting to a bolt plate 318 fitted to the lower end of the gear case assembly 306 thereby providing an inboard/outboard unit 320 without an exposed propeller 310. The lower unit 102' illustrated in FIG. 11, like the unit 102, shown in FIG. 2, includes a strut 104' extending from the bolt plate 318 to the housing of a stator 108'. For reasons which will be explained hereinafter, the unit 102' is preferably constructed like the lower unit 102 as illustrated and described above with reference to FIGS. 2–6D. That is, the lower unit 102' is constructed as a direct drive unit without a clutch and forward and reverse gear drive mechanism of the type illustrated in FIGS. 7A–7C.

The upper gear case assembly 306 may be constructed in a variety of ways to provide for forward and reverse drive of the pump jet lower unit 102'. One known example of such an assembly is shown in U.S. Pat. No. 3,269,497, the disclosure of which is specifically incorporated herein by reference. In the '497 patent, and as illustrated herein in FIGS. 12–15, an input shaft 330 driven by an engine mounted in the stern of a boat is provided with a bevel pinion 332 which is in constant mesh with two bevel wheels 334 and 336 which are freely rotatable on a shaft 338 adapted to drive the pump jet lower unit 102' via a bevel gear. The gear wheels 334 and 336 are facing each other so that the shaft 338 when connected to one or the other of the gear wheels will be driven in opposition directions. The gear wheels 334 and 336 are axially and radially mounted in a housing 342. Their confronting sides are secured to clutch members 344 and 346, respectively, having conical friction surfaces. A clutch element 348 disposed between the clutch members 344 and 346 and having two conical friction surfaces is mounted for turning and axial movement on steep pitch screw threads 350 on the shaft 338. In the normal position of the clutch which in this connection corresponds to the position for forward propulsion of the boat, one of the friction surfaces of the element 348 is in engagement with the friction surface of clutch member 344 under the action of a helical spring 352 or the like.

Reversing and shifting of the clutch to a neutral position is effected by means of a mechanical control system which by means of a rod, wire or the like, is connected to a remote control in the boat. The clutch element 348 has a central peripheral V-shaped groove 354 the center of which is eccentric to the axis of the shaft 338. Consequently, during rotation the sides of the groove will axially reciprocate. The groove receives a wedge-shaped sliding pin 356 which is eccentrically mounted for turning and axial movement in a control shaft 358 which also is mounted for turning and axial movement in a sleeve 360. The sliding pin 356 is forced into contact with the sides of the groove 354 by means of a helical spring 362 inserted between the end of the sliding pin 356 and the bottom of the bore in the control shaft 358 which has a radially directed lever 364 which by means of a rod 366 can be turned to different control positions. The sleeve 360 is connected with a cover which closes an opening in the housing 342 opposite the clutch element 348. At the end adjacent the sliding pin 356 the sleeve 360 has an axially directed cam 368 in engagement with a radially directed pin 370 on the control shaft 358. Consequently, when the control shaft is turned it is also moved axially. Detent means in the form of a spring-loaded ball or locking member 372 mounted in the sleeve 360 is provided to retain the control shaft in the different control positions by entering recesses 374 in this shaft. The cam 368 is formed such that the control shaft 358 in the neutral position of the clutch is forced inward toward the clutch element but can move outwards in the two positions of engagement.

The operation of the reversing mechanism can now be appreciated from the foregoing description. In operation with the clutch in engaged position for forward and backward propulsion the sliding pin 356 moves inwards and outwards in the V-groove 354 due to the eccentricity of the groove and under the action of the groove and under the action of the spring 362. If the control shaft 358 is turned toward its central position for clutch disengagement it is forced inwards towards the clutch element 348 by the pin 370 and the cam 368 cooperating therewith. Due to its eccentric mounting in the control shaft 358 the sliding pin 356 is simultaneously turned toward its central position. Since the clutch element is still in engaged position, the sliding pin 356 will be forced outward and the ride step by step up on one side of the V-groove 354. However, the axial outward movement of the sliding pin 356 is not great and is limited by a shoulder 378 which comes into contact with the end of the control shaft 358. Since this shaft cannot yield either, the clutch element 348 will be forced out of engagement with the clutch member 344 or 346 and the clutch will be disengaged under the action of the small effort required to turn the control shaft 358. Thus, with the forward/reverse gear drive and clutch assembly as just described, the lower unit 102' of the pump jet may be constructed as illustrated in FIGS. 2–6D with a simple direct drive arrangement provided by a bevel gear 138 and mating crown gear 140.

The tractor pump jet is typically used in the following manner. The user would remove the lower unit 22 of a prior art outboard 10, such as that illustrated in FIG. 1 or the lower unit 312 of the inboard/outboard unit 300 as illustrated in FIG. 10. The lower unit 22 would be replaced with the tractor pump jet lower unit 102 as shown in FIGS. 2–6D or 7A–7C. In the case of an inboard/outboard, the lower unit 312 would be replaced with the pump jet lower unit 102'. Alternatively, the pump jet lower units 102, 200 or 201' can be installed at the factory.

When used, the tractor pump jet has the following advantages:

First, it operates more efficiently because the water 118 drawn into the inlet 114 is relatively undisturbed and nonturbulent. This results in more efficient and faster exit flows 120 resulting in faster, forward motion 40 of the boat 12.

Second, the traditional antiventilation plate, such as illustrated as element 26 in FIG. 1 and element 314 in FIG. 10, is removed, thereby reducing drag.

Third, the operation of the tractor pump jet is safer than with prior art naked propellers, such as that illustrated as element 28 on the prior art outboard motor 10 shown in FIG. 1 and element 310 in FIG. 10.

Fourth, because the rotor housing 106 protects the rotor 132, the tractor pump jet is less likely to become fouled and caught up in lines, seaweed, kelp and the like.

While the invention has been described with reference to the preferred embodiment thereof, it would be appreciated by those of ordinary skill in the art, that various modifications can be made to the structure and function of the invention without departing from the spirit and scope thereof.

We claim:

1. A tractor pump jet marine propulsion apparatus comprising a power head, mounted within a water borne vehicle, a mounting bracket adapted to be mounted on the transom of said water borne vehicle, an upper gear case assembly extending from the mounting bracket, and a propulsion unit mounted on the gear case assembly, the propulsion unit having upper and lower ends and including a generally vertical drive shaft which is driven by the gear case assembly and which extends downwardly through the propulsion unit, a pump jet housing at the lower end of the propulsion unit, the pump jet housing being adapted to be submerged in open water and being externally streamlined for minimum drag losses in the water and maximum marine propulsion efficiency, the pump jet housing having an interior, a generally horizontal central axis and forward and rearward ends, the forward end of the pump jet housing defining an inlet opening, such that there is no intake conduit upstream of the inlet opening, the inlet opening having a crosssectional area, and the rearward end of the pump jet housing defining an outlet opening having a cross-sectional area less than the area of the inlet opening, the drive shaft extending into the interior of the pump jet housing, a rotor shaft extending along the central axis of the pump jet housing, the lower end of the drive shaft being drivingly connected to the rotor shaft, and an axial flow pump rotor mounted on the rotor shaft for rotation therewith, the rotor being located within the pump jet housing, immediately rearward of the inlet opening, and forward of the lower end of the drive shaft, the pump jet housing defining a flow passage which extends between the inlet opening and the outlet opening, which contains the rotor, and through which captured inlet water flows, the interior of the pump jet housing contacting the captured inlet water and being streamlined for minimum turbulence, minimum flow separation and minimum hydrodynamic losses and for maximum marine propulsion efficiency, the location of the rotor immediately rearward of the inlet opening and forward of the drive shaft causing the rotor to operate on relatively undisturbed water.

2. Apparatus as set forth in claim 1 wherein the propulsion unit also includes a stator hub surrounded by the pump jet housing, the stator hub having an exterior and being rearward of the rotor, and a plurality of stator vanes extending outwardly from the stator hub and connecting the stator hub to the pump jet housing.

3. Apparatus as set forth in claim 2 wherein each of the stator vanes has a leading edge that is non-parallel to the central axis of the pump jet housing.

4. Apparatus as set forth in claim 3 wherein each of the stator vanes has a trailing edge that is non-parallel to the central axis of the pump jet housing.

5. Apparatus as set forth in claim 1 wherein the propulsion unit also includes a nose cover covering the forward end of the rotor shaft, and a plurality of inlet struts extending outwardly from the nose cover and connecting the nose cover to the pump jet housing.

6. Apparatus as set forth in claim 1 wherein the flow passage has a cross-sectional area along the length thereof, the cross-sectional area of the passage decreasing rearwardly from adjacent the rotor to the outlet opening, such that the crosssectional area of the passage is smallest at the outlet opening.

7. Apparatus as set forth in claim 1 wherein the flow passage has a cross-sectional area along the length thereof, the cross-sectional area of the passage increasing rearwardly of the inlet opening to a point adjacent the rotor.

8. Apparatus as set forth in claim 1 wherein the rotor includes a hub mounted on the rotor shaft, and a plurality of blades, each of the blades having an inner end connected to the rotor hub, an outer edge, a leading edge forming a sharp corner with the outer edge, and a trailing edge forming a sharp corner with the outer edge.

9. Apparatus as set forth in claim 8 wherein each of the blades has a width between the leading and trailing edges, the width changing from the inner end to the outer edge, such that the width is greatest at the outer edge.

10. Apparatus as set forth in claim 8 wherein the outer edge defines part of a cylinder centered on the rotor shaft.

11. Apparatus as set forth in claim 1 wherein the pump jet housing includes a rotor housing having forward and rearward ends, the forward end of the rotor housing defining the inlet opening, and a stator housing having forward and rearward ends, the forward end of the stator housing being connected to the rearward end of the rotor housing, the rearward end of the stator housing defining the outlet opening.

12. Apparatus as set forth in claim 11 wherein the propulsion unit also includes a stator hub surrounded by the stator housing, the stator hub having an interior and an exterior, the drive shaft extending through the stator housing and into the interior of the stator hub, and a plurality of stator vanes extending outwardly from the stator hub and connecting the stator hub to the stator housing.

13. Apparatus as set forth in claim 12 wherein each of the stator vanes has a leading edge that is non-parallel to the central axis of the pump jet housing.

14. Apparatus as set forth in claim 13 wherein each of the stator vanes has a trailing edge that is non-parallel to the central axis of the pump jet housing.

15. Apparatus as set forth in claim 1 wherein the upper gear case assembly includes a forward and reverse drive and clutch assembly.

16. Apparatus as set forth in claim 15 wherein the drive shaft is drivingly connected to the rotor shaft by a pinion gear and crown gear.

17. Apparatus as set forth in claim 1 wherein the area of the inlet opening is approximately 2.25 times the area of the outlet opening.

18. Apparatus as set forth in claim 1 wherein the inlet opening is centered on the central axis and is located in a generally vertical plane.

19. Apparatus as set forth in claim 1 wherein the inlet opening is circular.

20. Apparatus as set forth in claim 1 wherein the propulsion unit also includes a closure plate fixed to the forward end of the stator hub to close the interior of the stator hub, and wherein the rotor shaft extends through the closure plate.

21. Apparatus as set forth in claim 1 wherein the propulsion unit also includes a nut threaded onto the forward end of the rotor shaft to secure the rotor to the rotor shaft, and a nose cover covering the forward of the rotor shaft and the nut to protect the nut, and a plurality of inlet struts extending outwardly from the nose cover and connecting the nose cover to the pump jet housing.

22. Apparatus as set forth in claim 21 wherein the nose cover extends forwardly of the inlet opening.

23. Apparatus as set forth in claim 21 wherein the propulsion unit also includes a cotter pin extending through the forward end of the rotor shaft to prevent the nut from backing off the rotor, and wherein the nose cover covers and protects the cotter pin.

24. Apparatus as set forth in claim 1 wherein the apparatus includes only one rotor.

25. Apparatus as set forth in claim 1 wherein the rotor has a diameter, and wherein the distance from the inlet opening to the rotor is less than one-half the diameter of the rotor.

26. Apparatus as set forth in claim 1 wherein the upper gear case assembly is mounted on the mounting bracket for pivotal movement about a generally horizontal tilt axis and about a generally vertical steering axis.

27. Apparatus as set forth in claim 26 wherein the propulsion unit also includes a support strut connected to the lower end of the gear case by a plurality of bolts, the support strut having a lower end, and wherein the pump jet housing is connected to the lower end of the support strut.

28. Apparatus as set forth in claim 1 wherein the flow passage has a cross-sectional area along the length thereof, the cross-sectional area of the passage changing such that the crosssectional area of the passage is smallest at the outlet opening.

29. Apparatus as set forth in claim 1 wherein the area of the inlet opening is substantially greater than the area of the outlet opening.

30. Apparatus as set forth in claim 1 wherein the rotor has a diameter, and wherein the distance from the inlet opening to the rotor is less than the diameter of the rotor.

31. A single-stage tractor pump jet marine propulsion apparatus comprising

A) mounting bracket adapted to be mounted on the transom of a water borne vehicle, and B) an outboard propulsion unit including 1) an upper gear case assembly mounted on the mounting bracket for pivotal movement about a generally horizontal tilt axis and about a generally vertical steering axis, the gear case assembly having a lower end, 2) a generally vertical drive shaft which is driven by a power head and which extends downwardly through the gear case assembly, and 3) a lower unit including a) a support strut connected to the lower end of the gear case assembly by a plurality of bolts, the support strut having a lower end, and b) a pump jet housing connected to the lower end of the support strut, the pump jet housing being adapted to be submerged in open water and being externally streamlined for minimum drag losses in the water and maximum marine propulsion efficiency, the pump jet housing including (i) a rotor housing having forward and rearward ends and a generally horizontal central axis, the forward end of the rotor housing defining an inlet opening, such that there is no intake conduit upstream of the inlet opening, the inlet opening being circular and having a cross-sectional area, the inlet opening being centered on the central axis and being located in a generally vertical plane, and (ii) a stator housing having forward and rearward ends and a central axis coaxial with the central axis of the rotor housing, the forward end of the stator housing being connected to the rearward end of the rotor housing, the rearward end of the stator housing defining an outlet opening having a cross-sectional area, the area of the inlet opening being greater than the area of the outlet opening, c) a stator hub surrounded by the stator housing, the stator hub having an interior and an exterior, the drive shaft extending through the stator housing and into the interior of the stator hub, d) a plurality of stator vanes extending outwardly from the stator hub and connecting the stator hub to the stator housing, e) a closure plate fixed to the forward end of the stator hub to close the interior of the stator hub, f) a rotor shaft having forward and rearward ends and extending along the central axis of the stator housing, the rotor shaft extending through the closure plate and being rotatably supported by the closure plate, the rearward end of the rotor shaft extending into the interior of the stator hub and being rotatably supported by the stator hub, the forward end of the rotor shaft extending forwardly of the stator hub, g) a pinion gear fixed to the lower end of the drive shaft within the interior of the stator hub, h) a forward-drive crown gear mounted on the rotor shaft within the interior of the stator hub, the crown gear meshing with the pinion gear such that rotation of the drive shaft causes rotation of the rotor shaft in a forward-drive direction when the crown gear is engaged with the rotor shaft, i) an axial flow pump rotor mounted on the forward end of the rotor shaft for rotation therewith, the rotor being located within the rotor housing, immediately rearward of the inlet opening, and forward of the stator hub, the rotor having a diameter and including a hub mounted on the rotor shaft, and a plurality of blades, each of the blades having an inner end connected to the rotor hub, an outer edge, a leading edge forming a sharp corner with the outer edge, a trailing edge forming a sharp corner with the outer edge, and a width between the leading and trailing edges, the width changing from the inner end to the outer edge, such that the width is greatest at the outer edge, the outer edges of the blades defining a cylinder centered on the rotor shaft, the distance from the inlet opening to the rotor being less than one-half the diameter of the rotor, j) a nose cover covering the forward end of the rotor shaft, the nose cover extending forwardly of the inlet opening, and k) a plurality of inlet struts extending outwardly from the nose cover and connecting the nose cover to the rotor housing, the stator housing, the rotor housing, the stator hub and the rotor hub defining, inside the stator housing and the rotor housing and outside of the stator hub and the rotor hub, a flow passage which extends between the inlet opening and the outlet opening, which has a crosssectional area along the length thereof, which contains the rotor, and through which captured inlet water flows, the crosssectional area of the passage changing such that the crosssectional area of the passage is smallest at the outlet opening, the stator housing and the rotor housing being externally streamlined for minimum drag losses in the water and for maximum marine propulsion efficiency, the interior of the stator housing and the rotor housing and the exterior of the stator hub and the rotor hub contacting the captured inlet water and being streamlined for minimum turbulence, minimum flow separation and minimum hydrodynamic losses and for maximum marine propulsion efficiency, the inlet struts providing structural integrity and minimization of turbulence of captured inlet water, the location of the rotor immediately rearward of the inlet opening and forward of the stator hub causing the rotor to operate on relatively undisturbed water.

32. Apparatus as set forth in claim 31 and further comprising a nut threaded onto the forward end of the rotor shaft to secure the rotor to the rotor shaft, and a cotter pin extending through the forward end of the rotor shaft to prevent the nut from backing off the rotor, and wherein the nose cover covers and protects the nut and the cotter pin.

33. Apparatus as set forth in claim 31 wherein each of the stator vanes has a leading edge that is non-parallel to the central axis of the pump jet housing.

34. Apparatus as set forth in claim 33 wherein each of the stator vanes has a trailing edge that is non-parallel to the central axis of the pump jet housing.

35. Marine apparatus comprising a water borne vehicle including a hull, the hull having a bottom and a transom, and a tractor pump jet including a power head positioned inside the vehicle, a mounting bracket mounted on the transom of the water borne vehicle, an upper gear case assembly extending from the mounting bracket, and an outboard propulsion unit mounted on the gear case assembly, the propulsion unit having upper and lower ends and including a generally vertical drive shaft which is driven by the power head and which extends downwardly through the propulsion unit, a pump jet housing at the lower end of the propulsion unit, the pump jet housing being located completely below the bottom of the hull, being adapted to be submerged in open water and being externally streamlined for minimum drag losses in the water and maximum marine propulsion efficiency, the pump jet housing having an interior, a generally horizontal central axis and forward and rearward ends, the forward end of the pump jet housing defining an inlet opening, such that there is no intake conduit upstream of the inlet opening, the inlet opening having a cross-sectional area, and the rearward end of the pump jet housing defining an outlet opening having a cross-sectional area less than the area of the inlet opening, the outlet opening being totally submerged when the vehicle is operating in water, the drive shaft extending into the interior of the pump jet housing, a rotor shaft extending along the central axis of the pump jet housing, the lower end of the drive shaft being drivingly connected to the rotor shaft, and an axial flow pump rotor mounted on the rotor shaft for rotation therewith, the rotor being located within the pump jet housing, immediately rearward of the inlet opening, and forward of the lower end of the drive shaft, the pump jet housing defining a flow passage which extends between the inlet opening and the outlet opening, which contains the rotor, and through which captured inlet water flows, the interior of the pump jet housing contacting the captured inlet water and being streamlined for minimum turbulence, minimum flow separation and minimum hydrodynamic losses and for maximum marine propulsion efficiency, the location of the rotor immediately rearward of the inlet opening and forward of the drive shaft causing the rotor to operate on relatively undisturbed water.

36. Marine apparatus comprising a water borne vehicle including a hull, the hull having a bottom and a transom, and a single-stage tractor pump jet including a mounting bracket mounted on the transom of the water borne vehicle, and an outboard propulsion unit including an upper gear case mounted on the mounting bracket for pivotal movement about a generally horizontal tilt axis and about a generally vertical steering axis, the gear case having a lower end, a generally vertical drive shaft which is driven by a power head and which extends downwardly through the mid-section, and a lower unit including a support strut connected to the lower end of the gear case by a plurality of bolts, the support strut having a lower end, and a pump jet housing connected to the lower end of the support strut, the pump jet housing being located completely below the bottom of the hull, being adapted to be submerged in open water and being externally streamlined for minimum drag losses in the water and maximum marine propulsion efficiency, the pump jet housing including a rotor housing having forward and rearward ends and a generally horizontal central axis, the forward end of the rotor housing defining an inlet opening, such that there is no intake conduit upstream of the inlet opening, the inlet opening being circular and having a cross-sectional area, the inlet opening being centered on the central axis and being located in a generally vertical plane, a stator housing having forward and rearward ends and a central axis coaxial with the central axis of the rotor housing, the forward end of the stator housing being connected to the rearward end of the rotor housing, the rearward end of the stator housing defining an outlet opening having a cross-sectional area, the outlet opening being totally submerged when the vehicle is operating in water, the area of the inlet opening being greater than the area of the outlet opening, a stator hub surrounded by the stator housing, the stator hub having an interior and an exterior, the drive shaft extending through the stator housing and into the interior of the stator hub, a plurality of stator vanes extending outwardly from the stator hub and connecting the stator hub to the stator housing, a closure plate fixed to the forward end of the stator hub to close the interior of the stator hub, a rotor shaft having forward and rearward ends and extending along the central axis of the stator housing, the rotor shaft extending through the closure plate and being rotatably supported by the closure plate, the rearward end of the rotor shaft extending into the interior of the stator hub and being rotatably supported by the stator hub, the forward end of the rotor shaft extending forwardly of the stator hub, a pinion gear fixed to the lower end of the drive shaft within the interior of the stator hub, a crown gear mounted on the rotor shaft within the interior of the stator hub, the crown gear meshing with the pinion gear such that rotation of the drive shaft causes rotation of the rotor shaft, an axial flow pump rotor mounted on the forward end of the rotor shaft for rotation therewith, the rotor being located within the rotor housing, immediately rearward of the inlet opening, and forward of the stator hub, the rotor having a diameter and including a hub mounted on the rotor shaft, and a plurality of blades, each of the blades having an inner end connected to the rotor hub, an outer edge, a leading edge forming a sharp corner with the outer edge, a trailing edge forming a sharp corner with the outer edge, and a width between the leading and trailing edges, the width changing from the inner end to the outer edge, such that the width is greatest at the outer edge, the outer edges of the blades defining a cylinder centered on the rotor shaft, the distance from the inlet opening to the rotor being less than one-half the diameter of the rotor, a nose cover covering the forward end of the rotor shaft, the nose cover extending forwardly of the inlet opening, and a plurality of inlet struts extending outwardly from the nose cover and connecting the nose cover to the rotor housing, the stator housing, the rotor housing, the stator hub and the rotor hub defining, inside the stator housing and the rotor housing and outside of the stator hub and the rotor hub, a flow passage which extends between the inlet opening and the outlet opening, which has a crosssectional area along the length thereof, which contains the rotor, and through which captured inlet water flows, the crosssectional area of the passage changing such that the crosssectional area of the passage is smallest at the outlet opening, the stator housing and the rotor housing being externally streamlined for minimum drag losses in the water and for maximum marine propulsion efficiency, the interior of the stator housing and the rotor housing and the exterior of the stator hub and the rotor hub contacting the captured inlet water and being streamlined for minimum turbulence, minimum flow separation and minimum hydrodynamic losses and for maximum marine propulsion efficiency, the inlet struts providing structural integrity and minimization of turbulence of captured inlet water, the location of the rotor immediately rearward of the inlet opening and forward of the stator hub causing the rotor to operate on relatively undisturbed water.

* * * * *